US005643709A

United States Patent [19]

Kamio et al.

[11] Patent Number: 5,643,709

[45] Date of Patent: Jul. 1, 1997

[54] THERMAL TRANSFER RECORDING MATERIAL

[75] Inventors: Takayoshi Kamio; Yasuhiro Ishiwata; Tomomi Tateishi, all of Kanagawa, Japan

[73] Assignee: Fuji Photo Film Co., Ltd., Kanagawa, Japan

[21] Appl. No.: 627,796

[22] Filed: Apr. 4, 1996

[30] Foreign Application Priority Data

Apr. 10, 1995 [JP] Japan ..... 7-083709

[51] Int. Cl.$^6$ ..... G03C 8/10

[52] U.S. Cl. ..... 430/201; 430/334; 430/339; 430/941; 430/964; 503/227

[58] Field of Search ..... 430/201, 200, 430/339, 334, 964; 503/227

[56] References Cited

U.S. PATENT DOCUMENTS 5,232,817 8/1993 Kawakami et al. ..... 430/201

5,246,909 9/1993 Thien et al. ..... 430/201

5,300,398 4/1994 Kasczuk ..... 430/201

5,468,591 11/1995 Pearce et al. ..... 430/201

*Primary Examiner*—Richard L. Schilling

*Attorney, Agent, or Firm*—Sughrue, Mion, Zinn, Macpeak & Seas

[57] ABSTRACT

A thermal transfer recording material capable of giving a color image having an excellent color reproducibility as well as good light fastness and free from fading, bleeding and contamination of an article contacted is provided. The thermal transfer recording material comprises a thermal transfer dye donating material containing the specified thermally migratable, dissociative heteryl azo dye of phenol or naphthol type and an image receiving material for thermal transfer printing, containing at least one of basic materials and mordants as a dye receiving compound.

16 Claims, No Drawings

THERMAL TRANSFER RECORDING MATERIAL

BACKGROUND OF THE INVENTION

1. Field of the Invention

This invention relates to a thermal transfer recording material for image recording by a thermal transfer system in which recording is carried out by allowing a dye to migrate from a dye donating material to an image receiving material by heating correspondingly to an image information.

2. Description of the Prior Art

A thermal transfer system has lately been developed to obtain a print from an image electronically formed by means of a color video camera. According to the method of obtaining such a print, a color-separated image is converted into an electrical signal which is then transmitted by wireless to a printer. To obtain a print, the dye donating material is face to face superposed on the image receiving material and inserted between a thermal head and platen roller. The thermal head is heated by turning on electric current according to the electrical signal transmitted. The dye donating material is heated from the back surface by the thermal head and the dye in the dye donating material is allowed to migrate to the image receiving material and imagewise recorded. In the case of a color image, this procedure is carried out by using in order yellow, magenta and cyan and optionally, a black dye donating material and heating to record the image.

Another method for thermally obtaining a print using the above described electrical signal is a method comprising using a laser instead of the thermal head. In this method, as a dye donating material, there is used a material strongly absorbing a laser light. When the laser light is irradiated on the dye donating material, this light-absorbable material converts the light energy into therermal energy, heats the dye donating material and thus, the dye is removed to the image receiving material. This light-absorbable material is contained in the dye donating layer or in contact with it. The laser light is modulated by an electrical signal and subjected to heating of the dye donating material.

It is preferred that as the dye donating material in the above described thermal transfer recording system, there is used a dye as readily thermally migratable as possible for the purpose of decreasing the load to the thermal head and increasing the recording rate. However, such a problem thus arises that the dye is precipitated or the dye is removed in the recorded image receiving material during storage or when allowed to stand in an atmosphere at a high temperture and high humidity, thus lowering the sharpness of an image or migrating to a substance in contact with it and contaminating the substance.

In order to solve this problem, there have been proposed methods comprising incorporating a mordant in an image receiving layer and thermally transferring a dye having a mordanting group such as phenolic hydroxyl group, etc., as disclosed in Japanese Patent Publication No. 15760/1992 and Japanese Patent Laid-Open Publication Nos. 188391/1989 and 83685/1991, and it has been proposed to use an aryl azo dye of phenol-type, as disclosed in Japanese Patent Laid-Open Publication No. 219061/1994.

According to these methods, the transferred dye is mordanted and is hard to be removed in the image receiving material, so the problem can be solved that the sharpness of an image is lowered and the dye migrates to a substance in contact with it to contaminate the substance.

The heat-migratable dyes used in these systems have various limitations and very few ones satisfy all the properties required. The properties required are, for example, that (1) the dye is readily heat-migrated, (2) the dye dissociates to give anion with a basic material and/or mordant contained in an image receiving layer and show spectral property preferable for color reproduction, (3) the dye is resistant to light or heat and resistant to various chemicals, (4) an image does not fade and the sharpness is not lowered, (5) retransferring of an image does not occur and (6) a heat-transfer dye donating material can readily be prepared.

SUMMARY OF THE INVENTION

It is an object of the present invention to provide a thermal transfer recording material for image recording by a thermal transfer system, whereby the disadvantages of the prior art can be overcome.

It is another object of the present invention to provide a thermal transfer recording material capable of giving an image with a high transferring property and excellent hue and fastness and free from lowering of the sharpness (fading of image) and color transferring (retransferring) by combination of an azo dye having a high heat-transferring property, excellent spectral property during dissociating, high spectral absorption coefficient and excellent in light and wet heat fastness with a basic material and/or mordant.

These objects can be attained by a thermal transfer recording material comprising a thermal transfer dye donating material containing a heat-migratable dye capable of donating hydrogen atom to be anion and an image receiving material for thermal transfer printing, containing at least one of basic materials and mordants as a dye receiving compound, in which at least one of the heat-migratable dyes is the specified heteryl azo dye of phenol type or its derivative.

DETAILED DESCRIPTION OF THE INVENTION

The inventors have made various efforts to dvelop a thermal transfer recording material, in particular, dye donating material capable of giving an image with a high transferring property and excellent hue and fastness and free from lowering of the sharpness and color retransferring and consequently, have reached the present invention.

Accordingly, the present invention provides a thermal transfer recording material comprising a thermal transfer dye donating material containing a thermally migratable dye capable of donating hydrogen atom to be anion and an image receiving material for thermal tranfer printing containing at least one of basic materials and mordants as a dye receiving compound, in which at least one of the thermally migratable dyes is a heteryl azo dye of phenol type represented by General Formula (1) or its derivative:

General Formula (1)

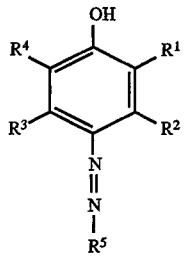

(1)

wherein $R^1$, $R^2$, $R^3$ and $R^4$ independently and respectively represent a hydrogen atom or atomic group of nonmetals, $R^3$ and $R^4$ may be bonded to form a five to six membered heterocyclic group and $R^5$ represents a heterocyclic group.

Furthermore, the object of the present invention can favorably be accomplished by the azo dye of General Formula (1), in which $R^5$ is a five to six membered heterocyclic group having at least one of nitrogen, oxygen and sulfur atoms, which may be condensed.

Preferred embodiments of the present invention will now be illustrated in detail:

In General Formula (1), $R^1$, $R^2$, $R^3$ and $R^4$ independently and respectively represent a hydrogen atom, halogen atoms, alkyl groups, aryl groups, heterocyclic groups, cyano group, hydroxyl group, nitro group, amino groups, alkoxy groups, aryloxy groups, acylamino groups, anilino groups, ureido groups, sulfamoylamino groups, alkylthio groups, arylthio groups, alkoxycarbonylamino groups, sulfonamido groups, carbamoyl groups, sulfamoyl groups, sulfonyl groups, alkoxycarbonyl groups, heterocyclic oxy groups, azo groups, acyloxy groups, carbamoyloxy groups, silyloxy groups, aryloxycarbonyl groups, aryloxycarbonylamino groups, imido group, heterocyclic thio groups, sulfinyl groups, phosphoryl groups, acyl groups, carboxy groups and sulfonic acid groups. $R^3$ and $R^4$ may be bonded to form a cyclic structure.

In greater detail, examples of $R^1$, $R^2$, $R^3$ and $R^4$ include hydrogen atoms; halogen atoms (e.g. fluorine, chlorine, bromine); alkyl groups (which has 1 to 18 carbon atoms and can be substituted by a substituent linked with oxygen atom, nitrogen atom, sulfur atom or carbonyl group, aryl groups, alkenyl groups, alkynyl groups, hydroxyl group, amino group, nitro group, carboxy groups, cyano groups or halogen atoms, for example, methyl group, isopropyl group, t-butyl group, trifluoromethyl group, methoxyethoxy group, 2-methanesulfonylethyl group, 2-methanesulfonamidoethyl group, cyclohexyl group, adamantyl group, etc.); aryl groups (6 to 18 carbon atoms, e.g. phenyl group, 4-t-butylphenyl group, 2-chlorophenyl group, 2-methoxyphenyl groups, etc.); heterocyclic groups (1 to 18 carbon atoms, e.g. 2-pyridyl group, 2-tetrahydrofuryl group, etc.); cyano group; hydroxyl group; nitro group; amino groups (0 to 18 carbon atoms, e.g. methylamino group, diethylamino group, etc.); alkoxy groups (1 to 18 carbon atoms, e.g. methoxy group, ethxoy group, 2-phenoxyethoxy group, 2-methoxyethoxy group, 2-methanesulfonylethoxy group, etc.); aryloxy groups (6 to 18 carbon atoms, e.g. phenoxy group, 2-methoxyphenoxy group, etc.); acylamino groups (2 to 18 carbon atoms, e.g. acetamido group, benzamido group, etc.); anilino groups (6 to 18 carbon atoms, e.g. phenylamino group, 2-chloroanilino group, etc.); ureido groups (1 to 18 carbon atoms, e.g. phenylureido group, methylureido group, etc.); sulfamoylamino groups (0 to 18 carbon atoms, e.g. N,N-dipropylsulfamoylamino group, etc.); alkylthio groups (1 to 18 carbon atoms, e.g. methylthio group, 2-phenoxythio group, etc.); arylthio groups (6 to 18 carbon atoms, e.g. phenylthio group, etc.); alkoxycarbonylamino groups (2 to 18 carbon atoms, e.g. methoxycarbonylamino groups, etc.); sulfonamido groups (1 to 18 carbon atoms, e.g. methanesulfonamido group, benzenesulfonamido group, etc.); carbamoyl groups (1 to 18 carbon atoms, e.g. N-ethylcarbamoyl group, N-phenylcarbamoyl group, etc.); sulfamoyl groups (0 to 18 carbon atoms, e.g. N-ethylsulfamoyl group, N,N-diethylsulfamoyl group, etc.); sulfonyl groups (1 to 18 carbon atoms, e.g. methanesulfonyl group, toluenesulfonyl group, etc.); alkoxycarbonyl groups (2 to 18 carbon atoms, e.g. methoxycarbonyl group, butoxycarbonyl group, etc.); heterocyclic oxy groups (1 to 18 carbon atoms, e.g. 2-tetrahydropyranyloxy group, etc.); azo groups (3 to 18 carbon atoms, e.g. p-nitrophenylazo group, etc.); acyloxy groups (2 to 18 carbon atoms, e.g. acetoxy group, etc.); carbamoyloxy groups (1 to 18 carbon atoms, e.g. N-methylcarbamoyloxy group, etc.); silyloxy groups (3 to 18 carbon atoms, e.g. trimethylsilyloxy group, etc.); aryloxycarbonylamino groups (7 to 18 carbon atoms, e.g. phenoxycarbonylamino group, etc.); imido groups (4 to 18 carbon atoms, e.g. N-phthalimido group, N-succinimido group, etc.); hetrocyclic thio group (1 to 18 carbon atoms, e.g. 2-pyridylthio group, etc.); phosphonyl groups (0 to 18 carbon atoms, e.g. phenoxyphosphonyl group, phenylphosphonyl group, etc.); acyl groups (1 to 18 carbon atoms, e.g. acetyl group, benzoyl group, etc.); carboxy groups (inorganic salts such as sodium salt, potassium salt, etc. salts with organic bases such as tetramethyl guanidine salt, etc.); and sulfonate groups (inorganic salts such as sodium salt, potassium salt, etc. salts with organic bases such as tetramethyl guanidine salt, etc.).

Above all, preferred ones are a hydrogen atom, halogen atoms (fluorine, chlorine, bromine), alkyl groups (1 to 8 carbon atoms), cyano group, alkoxy groups (1 to 8 carbon atoms), acylamino groups (2 to 8 carbon atoms), ureido groups (1 to 12 carbon atoms), alkoxycarbonylamino groups (2 to 12 carbon atoms), sulfamoyl groups (0 to 12 carbon atoms), carbamoyl groups (1 to 12 carbon atoms) and alkoxycarbonyl groups (2 to 12 carbon atoms).

$R^5$ represents a heterocyclic group, in particular, heterocyclic aromatic amine residual group capable of being diazotized, preferably a five to six membered aromatic heterocyclic group having at least one of nitrogen, oxygen and sulfur atoms, which may be condensed.

Examples of these groups are 2-thiazolyl, 2-benzothiazolyl, 3-benzothiazolyl, 1,3,4-thiazole-2-il, 1,2,4-thiazole-5-il, 3-pyrazolyl, 5-pyrazolyl, 2-thienyl, 2-imidalyl, 2-benzimidazolyl, 3-isooxazolyl, 5-isothiazolyl, 2-oxazolyl, 2-benzoxazolyl, 2-pyridyl, 4-pyridyl, 2-quinolyl and 4-quinolyl groups. These groups can have the groups defined in $R^1$, $R^2$, $R^3$ and $R^4$ as substituents.

Above all, preferred groups are 5-membered heterocyclic groups, more preferably 5-membered heterocyclic groups having sulfur atoms, most preferably 2-thiazolyl, 2-benzothiazolyl, 1,3,4-thiazole-2-il, 1,2,4-thiazole-5-il, 2-thienyl and 5-isothiazolyl groups.

A dye in which $R^3$ and $R^4$ are bonded to form a ring structure can be represented by the following General Formula (2) or (3):

General Formula (2) or (3)

(2)

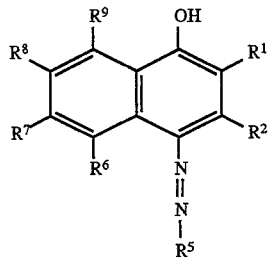

(3)

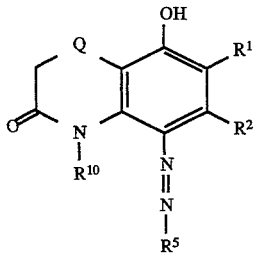

wherein $R^1$, $R^2$ and $R^5$ have the same meanings as defined in General Formula (1), $R^6$, $R^7$, $R^8$ and $R^9$ have the same meanings as defined in $R^1$ of General Formula (1) and $R^{10}$ is a hydrogen atom or an alkyl group (1 to 12 carbon atoms).

Q is an atomic group necessary for forming a 5 to 7 membered ring.

The dye of General Formula (2) preferably includes the following cases:

$R^1$ is a hydrogen atom, acylamino group (2 to 12 carbon atoms), sulfamoyl group (1 to 12 carbon atoms), carbamoyl group (2 to 12 carbon atoms) or sulfonamido group (1 to 12 carbon atoms), $R^2$ is a hydrogen atom, $R^6$ and $R^9$ are hydrogen atoms, sulfonamido groups (1 to 12 carbon atoms), acylamino groups (2 to 12 carbon atoms) and alkoxycarbonylamino groups (2 to 12 carbon atoms), $R^7$ and $R^8$ are hydrogen atoms and $R^5$ has the same meanings as given as the preferred heterocyclic group in General Formula (1).

The dye of General Formula (3) preferably includes the following cases:

$R^1$ is a hydrogen atom or acylamino group (2 to 12 carbon atoms), $R^2$ is a hydrogen atom, $R^{10}$ is a hydrogen atom, Q is $—CR^{11}R^{12}—$ or $—CR^{11}R^{12}—CR^{13}R^{14}—$ wherein $R^{11}$, $R^{12}$, $R^{13}$ and $R^{14}$ are independently and respectively hydrogen atoms or alkyl groups (1 to 6 carbon atoms). A low pKa is required for the above described dye to dissociate and to be mordanted in an image receiving layer and it is preferable to select a substituent so that pKa may be at most 8, more preferably 6 to 1.

Examples of the dye represented by General Formula (1), used in the present invention, are shown in the following Tables 1 to 3 without limiting the same.

TABLE 1

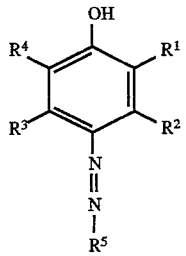

| DyeNo. | $R^1$ | $R^2$ | $R^3$ | $R^4$ | $R^5$ |
|---|---|---|---|---|---|
| 1 | Cl | H | Cl | H | 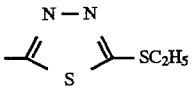 |
| 2 | " | " | " | " | 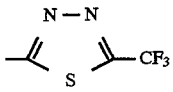 |
| 3 | " | " | " | " | 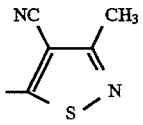 |
| 4 | " | " | " | " | 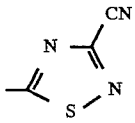 |
| 5 | " | " | " | " | 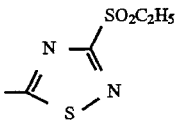 |

TABLE 1-continued
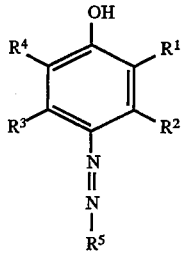
| DyeNo. | $R^1$ | $R^2$ | $R^3$ | $R^4$ | $R^5$ |
|---|---|---|---|---|---|
| 6 | " | " | " | " | 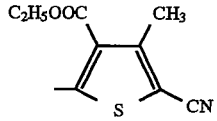 |
| 7 | " | " | H | Cl | 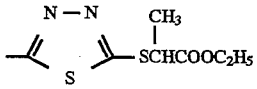 |
| 8 | " | " | " | " | 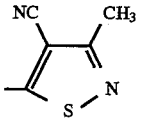 |
| 9 | " | " | " | " | 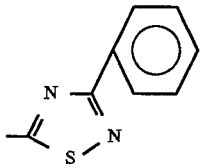 |
| 10 | " | " | " | " | 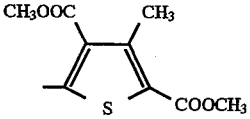 |
| 11 | F | F | F | F | 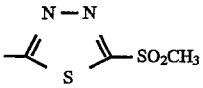 |
| 12 | " | " | " | " | 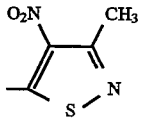 |
| 13 | " | " | " | " | 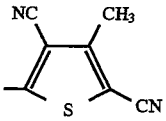 |
| 14 | Cl | H | $-NHCOCH_3$ | H | 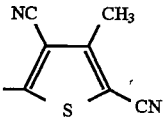 |
| 15 | $-NHCOCH_3$ | " | " | " | 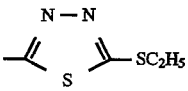 |
| 16 | " | " | $-CH_3$ | Cl | " |

TABLE 1-continued
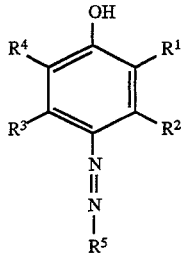
| DyeNo. | $R^1$ | $R^2$ | $R^3$ | $R^4$ | $R^5$ |
|---|---|---|---|---|---|
| 17 | $-NHCOCF_3$ | " | $-NHCOCF_3$ | H | 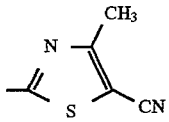 |
| 18 | $-NHCO-CH(C_2H_5)(C_4H_9)$ | " | $-NHCOCH_3$ | " | 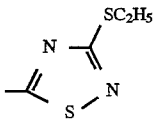 |
| 19 | $-NHCOCF_3$ | H | $-COCH_3$ | H | 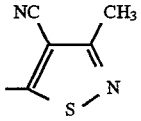 |
| 20 | $-OCH_3$ | " | H | $-OCH_3$ | 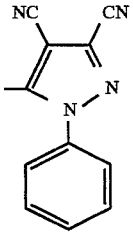 |
| 21 | Cl | Cl | " | H | 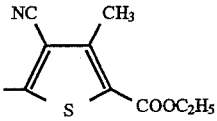 |
| 22 | $-NHCONHCH_3$ | H | $CH_3$ | " | 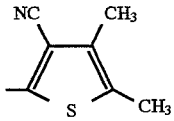 |
| 23 | $-NHCOCH_3$ | " | H | $-NHCOCH_3$ | 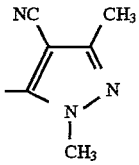 |
| 24 | $-NHCOCH_3$ | H | H | $-NHCOCH_3$ | 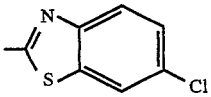 |
| 25 | " | " | " | " | 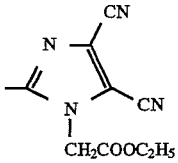 |

TABLE 1-continued
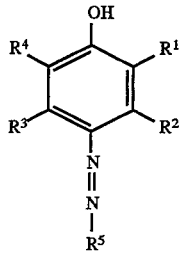
| DyeNo. | $R^1$ | $R^2$ | $R^3$ | $R^4$ | $R^5$ |
|---|---|---|---|---|---|
| 26 | 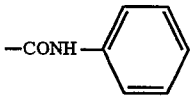 | " | " | H | " |
| 27 | $-NHCOC_2H_5$ | " | " | $-COCH_2H_5$ | 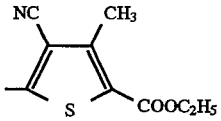 |
| 28 | $-OCH_3$ | " | " | $-OCH_3$ | 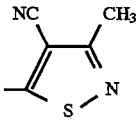 |
TABLE 2
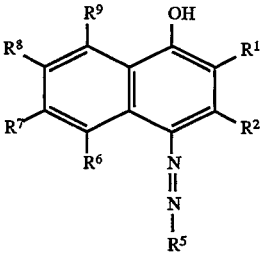
| DyeNo. | $R^1$ | $R^2$ | $R^6$ | $R^7$ | $R^8$ | $R^9$ | $R^5$ |
|---|---|---|---|---|---|---|---|
| 29 | H | H | $-NHSO_2C_4H_9$ | H | H | H | 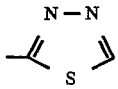 |
| 30 | 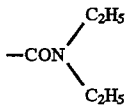 | " | " | " | " | " | 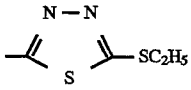 |
| 31 | 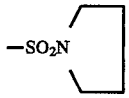 | " | " | " | " | " | 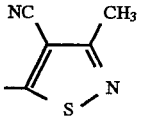 |
| 32 | " | " | $-NHCOOC_2H_5$ | " | " | " | 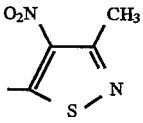 |

TABLE 2-continued
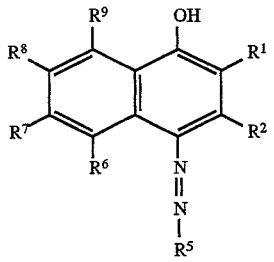
| DyeNo. | $R^1$ | $R^2$ | $R^6$ | $R^7$ | $R^8$ | $R^9$ | $R^5$ |
|---|---|---|---|---|---|---|---|
| 33 | " | " | $-NHSO_2CH_2CH_2OCH_3$ | " | " | " | 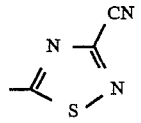 |
| 34 | $-SO_2N(C_2H_5)_2$ | " | " | " | " | " | 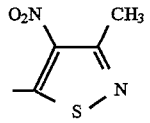 |
| 35 | $-SO_2N(C_2H_5)_2$ | H | $-NHSO_2CH_2CH_2OCH_3$ | H | H | H | 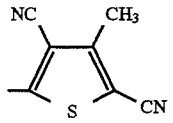 |
| 36 | $-CH$ | " | " | " | " | " | 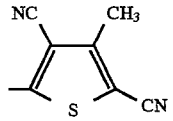 |
| 37 | $-NHCOC_2H_5$ | " | " | " | " | " | 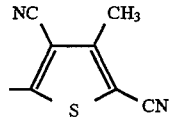 |
| 38 | " | " | $-NHSO_2CH_3$ | " | " | " | 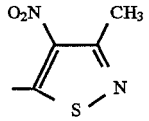 |
| 39 | " | " | " | " | " | " | 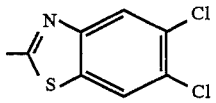 |
| 40 | H | " | " | " | " | $-NHCOC_2H_5$ | 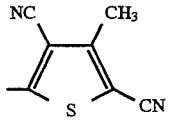 |

TABLE 3

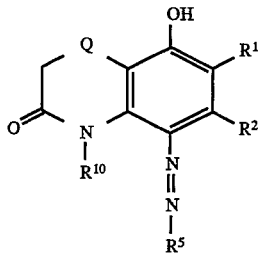

| DyeNo. | $R^1$ | $R^2$ | $R^{10}$ | Q | $R^5$ |
|---|---|---|---|---|---|
| 41 | $-NHCOC_4H_9(t)$ | H | $-CH_3$ | $-C(CH_3)_2-$ | 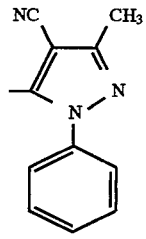 |
| 42 | " | " | H | " | 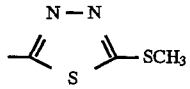 |
| 43 | " | " | " | " | 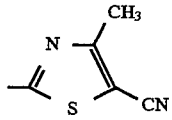 |
| 44 | $-NHCOC_3F_7$ | " | " | " | 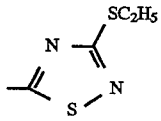 |
| 45 | $-NHCOCH_3$ | " | " | $-CH_2-C(CH_3)_2-$ | 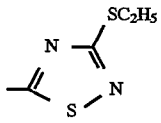 |
| 46 | " | " | " | " | 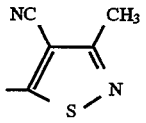 |
| 47 | " | " | " | " | 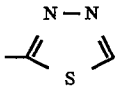 |

The thermally migratable dye of the present invention is contained in a color material layer on a substrate and used as a thermal transfer dye donating material for forming an image by the thermal transfer system. A preferred embodiment will be illustrated in detail in the case of using the thermally migratable dye of the present invention for forming an image by the thermal transfer system.

For forming a full color image, ordinarily, it is required to use three color dyes, i.e. yellow, magenta and cyan.

Thus, formation of the full color image can be carried out by using the dye represented by General Formula (1) as a magenta dye or cyan dye and selecting other colors from the known dyestuffs. The other colors are preferably dissociative dyes similar to those used in the present invention, for example, azomethine dyes and methine dyes having phenolic hydroxyl group. As to a same color, the dye of the present invention and the knwon dye can be used in admixture. At least two of the dyes of the present invention can be used in admixture as a same color.

The thermal transfer dye donating material can be used in the form of a sheet, continuous roll or ribbon. Each dye of yellow, magenta and cyan is ordinarily arranged on a substrate in such a manner that independent zones are respectively formed. For example, regions of yellow, magenta and yellow dyes are in plane order or in linear order on one substrate. Alternatively, the above described yellow dye, magenta dye and cyan dye are respectively provided on separate substrates to prepare three kinds of thermal transfer dye donating materials, from which these dyes are then transferred in order to one image receiving material for thermal transfer printing.

The dyes of the present invention can respectively be dissolved or dispersed in a suitable solvent with a binder resin and coated onto a substrate, or can be printed on a substrate by a printing method such as gravure method. The thickness of a dye donating layer containing these dyes is generally about 0.2 to 5 μm, particularly 0.4 to 2 μm on dry basis. The coating amount of the dye is generally in a range of 0.03 to 1 g/m$^2$, preferably 0.1 to 0.6 g/m$^2$.

As the binder resin for the above described dyes, there can be used any binder resins which have commonly been used to this end, and selection thereof is ordinarily carried out from those which have high heat resistance and do not hinder migration of the dye when heated, for example, polyamide resins, polyester resins, epoxy resins, polyurethane resins, polyacrylic resins such as polymethyl methacrylate, polyacrylamide, polystyrene-2-acrylonitrile, etc., vinyl type resins including polyvinylpyrrolidone, polyvinyl chloride resins such as vinyl chloride-vinyl acetate copolymer, etc., polycarbonate resins, polystyrenes, polyphenylene oxides, cellulose resins such as methyl cellulose, ethyl cellulose, carboxymethyl cellulose, cellulose acetate hydrogen phthalate, cellulose acetate, cellulose acetate propionate, cellulose acetate butyrate, cellulose triacetate, polyvinyl alcohol resins such as partially saponified polyvinyl alcohols such as of polyvinyl alcohol, polyvinyl acetal, polyvinyl butyral, etc., petroleum resins, rosin derivatives, cumarone-indene resins, terpene resins, polyolefin resins such as polyethylene, polypropylene, etc., and the like.

In the present invention, these binder resins are preferably used in a proportion of about 20 to 600 weight parts to 100 weight parts of the dye. In the present invention, as an ink solvent for dissolving or dispersing the above described dye and binder resin, there can be used any ink solvents known in the art.

As a substrate for a thermal transfer dye donating material, there can be used any materials known in the art, for example, polyethylene terephthalates, polyamides, polycarbonates, glassine papers, condenser papers, cellulose esters, fluoro polymers, polyethers, polyacetals, polyolefins, polyimides, polyphenylene sulfides, polypropylenes, polysulfones, cellophanes and the like.

The thickness of the substrate of the thermal transfer dye donating material is generally 2 to 30 μm. Optionally, an undercoated layer can be provided. In addition, a dye diffusion inhibiting layer consisting of a hydrophilic polymer can be provided between the substrate and dye donating layer to further improve the transfer density. As the hydrophilic polymer, the above described water-soluble polymers can be used.

Furthermore, a slipping layer can be provided so as to prevent a thermal head from adhesion to the dye donating material. This slipping layer is generally formed of a lubricant containing or not containing polymeric binders, for example, surfactants, solid or liquid lubricants or mixtures thereof.

When a dye donating material is subjected to printing from the back surface thereof, it is preferable to subject the dye donating layer-free side of a substrate to a sticking prevention treatment so as to prevent sticking due to the heat of a thermal head and improve slipping. For example, a heat resistant slipping layer is preferably provided consisting mainly of ① a reaction product of a polybutyral resin and isocyanate, ② an alkali metal salt or alkaline earth metal salt of phosphoric acid ester and ③ a filler. Preferably, the polyvinyl butyral resin has a molecular weight of about $6\times10^4$ to $20\times10^4$ and a glass transition temperature of 80° to 110° C. and contains a vinyl butyral moiety of 15 to 40 weight % preferred from such a standpoint that there are a number of reaction sites with the isocyanate. As the alkali metal salt or alkaline earth metal salt of phosphoric acid ester, there is preferably used Gafack RD 720 -commercial name- manufactured by Toho Kagaku KK in a proportion of 1 to 50 weight %, more preferably 10 to 40 weight % based on the polyvinyl butyral resin.

The heat resistant slipping layer preferably has a heat resistant lower layer which should preferably be provided by coating a combination of a synthetic resin hardenable by heating and its hardening agent, for example, combinations of polyvinyl butyral and polyvalent isocyanate, acrylic polyol and polyvalent isocyanate, cellulose acetate and titanium chelating agent or polyester and organo titanium compound.

In the dye donating material, a hydrophilic barrier layer can sometimes be provided for the purpose of preventing diffusion of the dye toward the substrate. The hydrophilic dye barrier layer contains a hydrophilic material useful for this purpose. Excellent results can generally be obtained by the use of gelatin, poly(acrylamide), poly (isopropylacrylamide), butyl methacrylate grafted gelatin, ethyl methacrylate grafted gelatin, cellulose monoacetate, methyl cellulose, poly(vinyl alcohol), poly(ethyleneimine), poly(acrylic acid), a mixture of poly(vinyl alcohol) and poly(vinyl acetate), mixture of poly(vinyl alcohol) and poly (acrylic acid) and mixture of cellulose monoacetate and poly(acrylic acid). Poly(acrylic acid), cellulose monoacetate and poly(vinyl alcohol) are particularly preferable.

In the dye donating material, an undercoated layer can be provided. Any undercoated layer capable of favorably functioning can be provided by coating, for example, (acrylonitrile-vinylidene chloride-acrylic acid) copolymer (14:80:6 weight ratio), (butyl acrylate-2-aminoethyl methacrylate-2-hydroxyethhyl methacrylate) copolymer (30:20:50 weight ratio), linear saturated polyester such as Bostick 7650 (Emheart Co., Bostick Chemical Group) or chlorinated high density poly(ethylene-trichloroethylene) resin. The coating amount of the undercoated layer is not particularly limited, but is ordinarily in the range of 0.1 to 2.0 g/m$^2$.

In the present invention, a thermal transfer dye donating material is superposed on an image receiving material for thermal transfer printing and thermal energy according to an image information is given by a heating means such as thermal head from any surface of these materials, prefrably from the back surface of the thermal transfer dye donating material. Thus, the dye in the dye donating material can be transferred to the image receiving material for thermal transfer printing depending on the intensity of the heating energy to obtain a color image having an excellent gradation of sharpness and resolving degree. Moreover, a fading inhibitor can similarly be transferred.

The heating means is not limited to such a thermal head, but known heating means such as laser lights (e.g. semiconductor lasers), infrared flashes, thermal pens, etc.

In a system using a laser beam, the dye donating material contains a material capable of strongly absorbing the laser beam. When the laser beam is irradiated on the dye donating material, this absorbing material converts the light energy into thermal energy and the heat is transmitted to the adjacent dye to heat the dye to the heat-migrating temperature, thereby transferring the dye to the image receiving material. The absorbing material is present in the form of a layer below the dye and/or is mixed with the dye. The laser beam is modulated by a set of electrical signals which is representative of the shape and color of an original image so that the dye is heated and thermally transferred only in those areas in which its presence is required on the dye donating material to reconstruct the color of the original object color. The detailed illustration of this process is described in GB 2083726 A.

The absorbing material disclosed as that for a laser system in GB 2083726A is carbon. In the present invention, the thermal transfer dye donating material can be utilized for printing using various printers by a thermal printing system, preparing an image by a facsimile, magnetic recording system, optical recording system, etc., preparing a print from a television picture, CRT picture, etc., in combination with the image receiving material for thermal transfer printing.

Details of the thermal transfer recording method are described in Japanese Patent Laid-Open Publication No. 34895/1985, incorporated herein by reference.

In a preferred embodiment of the present invention, the dye donating material is obtained by coating a polyethylene terephthalate substrate in order with cyan dye, magenta dye and yellow dye in a reiterating zone and practicing in order the above described steps every color to form a transferred three color image. When this step is carried out by monochrome, of course, a transferred monochromatic image is obtained. For thermally transferring the dye from the dye donating material to the image receiving material, various lasers can be used, for example, ion gas lasers such as argon, krypton lasers, etc., metallic vapor lasers such as copper, gold, cadmium vapor lasers, etc., solid lasers such as ruby, YAG lasers, etc., semiconductor lasers such as gallium arsenide lasers emitting in an infrared region of 750 to 870 nm. In practice, however, semiconductor lasers are useful in respect of small size, low cost, stability, reliability, durability and ease of modulation.

The image receiving material for thermal tranfer printing used in combination with the thermal transfer dye donating material of the present invention comprises an image receiving layer provided on a substrate, the image receiving layer containing at least one of basic materials and mordants (which will hereinafter be referred to as "dye fixing agent"), which are capable of receiving a dye migrated from the dye donating material on the substrate and dissociating the received dye, individually or in combination with a binder material.

This dye fixing agent includes compounds having primary to tertiary amino groups, preferably tertiary amino groups, compounds having nitrogen-containing heterocyclic groups and compounds having quaternary cation groups thereof. Above all, polymeric fixing agents are particularly preferable, illustrative of which are disclosed in Japanese Patent Laid-Open Publication Nos. 260060/1985, 260381/1985, 188391/1989 and 83685/1991 and Japanese Patent Application Nos. 52995/1986 and 137463/1993. Among these polymer dye fixing agents, it is most preferable to use those having tertiary amino group as a pendant.

Examples of the polymer dye fixing agent used in the present invention will be given without limiting the same.

A-1

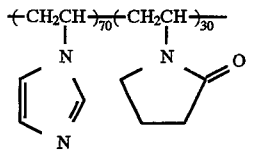

A-2

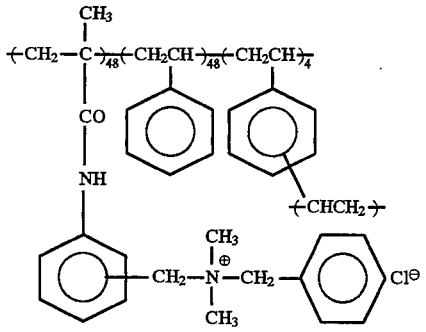

(water-dispersed latex)

A-3

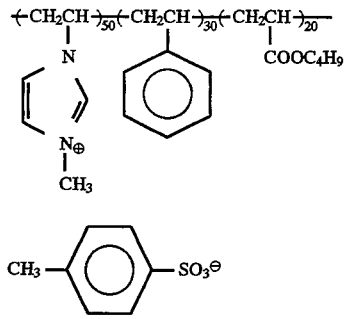

A-4

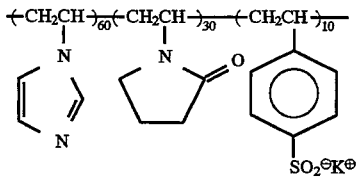

A-5

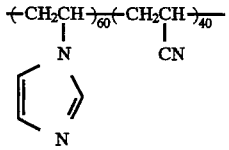

A-6

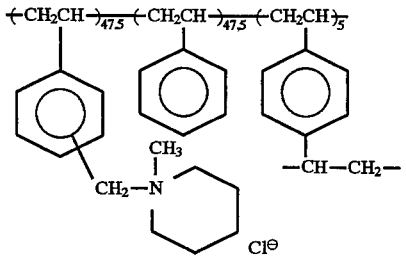

(aqueous dispersed latex)

-continued

A-7

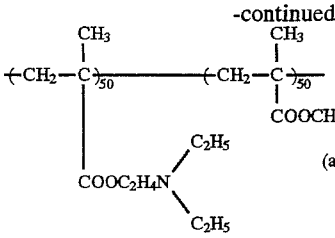

(aqueous dispersed latex)

A-8

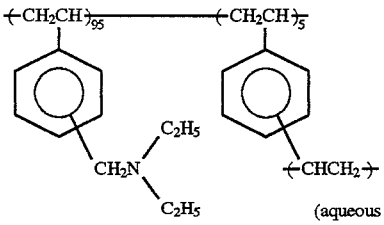

(aqueous dispersed latex)

A-9

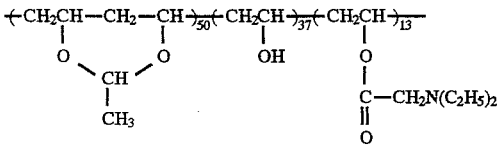

(AEA "Sankyo")

A-10

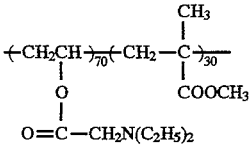

A-11

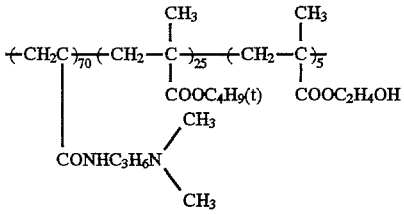

A-12

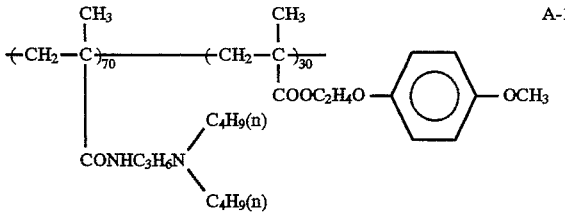

A-13

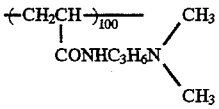

The molecular weight of the polymer dye fixing agent of the present invention is suitably $1\times10^3$~$1\times10^6$, more preferably $1\times10^4$~$2\times10^5$. The above described dye fixing agent can individually form a receiving layer, but may be dispersed in or mixed with other binders. In particular, those having molecular weights of at most $1\times10^3$ are preferably used by dispersing in or mixing with other binders. The coating amount of the dye fixing agent is suitably 0.2 to 30 g/m$^2$, preferably 0.5 to 15 g/m$^2$. Tg of the dye fixing agent is generally 0° to 120° C., preferably 30° to 70° C.

When using the dye fixing agent with a synthetic resin as a binder, the quantity of the dye fixing agent can readily be determined by those skill in the art, depending on the variety or composition of the dye fixing agent and on the image forming process employed, but the synthetic resin is preferably used in a proportion of fixing agnet/synthetic resin in the range of 10/90 to 100/0.

As the synthetic resin, there can be used any ones capable of receiving a dye migrated from a transfer sheet, illustrative of which are the following Synthetic Resins (a) to (f):

(a) Synthetic Resins having ester bonds

Polyester resins obtained by condensation of dicarboxylic acid components such as terephthalic acid, isophthalic acid, succinic acid, etc. (which can be substituted with sulfo group, carboxylic group, etc.) with ethylene glycol, propylene glycol, neopentyl glycol, bisphenol A, etc.; polyacrylic acid ester resins or polymethacrylic acid ester resins, such as polymethyl acrylate, polybutyl acrylate, polymethyl methacrylate, polybutyl methacrylate, etc.; polycarbonate resins; polyvinyl acetate resins; styrene acrylate resins; vinyl toluene acrylate resins. For example, they are dsiclosed in Japanese Patent Laid-Open Publication Nos. 101395/1984, 7971/1988, 7972/1988 and 7973/1988 and 294862/1985. As commercially available articles, there are Byron 290, Byron 200, Byron 280, Byron 300, Byron 103, Byron GK-140 and Byron GK-130, commercial names manufactured by Toyobo KK, and ATR-2009 and ATR-2010, commercial names manufactured by Kao KK.

(b) Synthetic Resins having urethane bonds

Polyurethane resins, etc.

(c) Synthetic Resins having amide bonds

Polyamide resins, etc.

(d) Synthetic Resins having urea bonds

Polyurea resins, etc.

(e) Synthetic Resins having sulfone bonds

Polysulfone resins, etc.

(f) Synthetic Resins having other high polarity bonds

Polycaprolactone resins, styrene-maleic anhydride resins, polyacrylonitrile resins, etc.

In addition to these synthetic resins, mixtures or copolymers thereof can be used.

In the image receiving material for thermal transfer printing, in particular, image receiving layer, a high boiling point organic solvent or thermal solvent can be incorporated as a material for receiving the thermally migratable dye or as a color diffusing agent.

Examples of the high boiling point organic solvent or thermal solvent are compounds disclosed in Japanese Patent Laid-Open Publication Nos. 174754/1987, 245253/1987, 209444/1986, 200538/1986, 8145/1987, 9348/1987, 30247/1987 and 136646/1987.

The image receiving layer in the image receiving material for thermal transfer printing of the present invention may be formed by dispersing a material capable of receiving the thermally migratable dye in a water-soluble binder, followed by supporting. In this case, various known water-soluble polymers can be usd as the water-soluble polymer, but a water-soluble polymer having a group capable of effecting crosslinking reaction by a hardener is preferable.

The image receiving layer may be composed of two or more layers. In this case, it is preferable to use a synthetic resin having a low glass transition temperature for the adjacent layer to a substrate or to use a high boiling point organic solvent or thermal solvent therefor so as to increase the dyeing property to the dye. Furthermore, it is preferable to use, for the outermost layer, a synthetic resin having a high glass transition temperature or to use a high boiling point organic solvent or thermal solvent in an irreducible minimum quanity of demand or not use it, so that some troubles, for example, stickiness of the surface, adhesion to other materials, retransferring to other materials after transferring, blocking to the thermal transfer dye donating material can be prevented.

The thickness of the image receiving layer, as a whole, is generally 0.5 to 50 μm, preferably 3 to 30 μm and that of the outermost layer in the case of two layer structure is generally 0.1 to 2 μm, preferably 0.2 to 1 μm.

The image receiving layer of the present invention can be provided with an intermediate layer between the substrate and image receiving layer. This intermediate layer is preferably a layer having one or more functions of cushioning layers, porous layers and dye diffusion preventing layers and if necessary, plays a role as an adhesives.

The dye diffusion preventing layer plays a role of preventing the thermally migratable dye from diffusin to the substrate. As a binder for composing the dye diffusion preventing layer, water-soluble or organic solvent-soluble binders can be used and above all, water-soluble binders as exemplified in the foregoing image receiving layer, in particular, gelatin is preferable.

The porous layer is a layer capable of preventing the heat applied during thermally transferring from diffusing from the image receiving layer to the substrate and thus, effectively utilizing the heat applied.

In the image receiving layer, cushioning layer, porous layer, diffusion preventing layer, adhesive layer, etc. for composing the image receiving material for thermal transfer printing of the present invention can be incorporated silica, clay, talc, diatom earth, calcium carbonate, calcium sulfate, barium sulfate, aluminumsilicate, synthetic zeolites, zinc oxide, lithopone, titanium oxide, alumina and the like.

As the substrate for the image receiving material for thermal transfer printing of the present invention, there can be used any materials capable of being resistant to the transferring temperature and satisfying the requisites for, e.g. smoothness, whiteness, sliding property, antifriction property, antistatic property, depression after transferred, etc., illustrative of which are paper substrates, for example, synthetic papers such as those of polyolefin type or polystyrene type, high quality papers, art papers, coated papers, cast coated papers, wallpapers, backing papers, synthetic resin- or emulsion-impregnated papers, synthetic rubber latex-impregnated papers, synthetic resin-lining papers, paste boards, cellulose fiber papers, polyolefin-coated papers (in particular, papers whose both surfaces are coated with polyethylene), various plastic films or sheets such as of polyolefins, polyvinyl chloride, polyethylene terephthalate, polystyrene, methacrylates, polycarbonates, etc., these films or sheets processed to give white reflection, and laminated bodies in any combinations thereof.

For the image receiving material for thermal transfer printing, flurescent whitening agents can be used, for example, compounds described in K. Vevnkataraman "The Chemistry of Synthetic Dyes", Vol. 5, Sec. 8, Japanese Patent Laid-Open Publication No. 143752/1986. Particularly, such compounds include stilbene compounds, coumarin compounds, biphenyl compounds, benzaoxazolyl compounds, naphthalimido compounds, pyrazoline compounds, carbostyryl compounds, 2,5-dibenzooxazolethiophene and like.

The flurescent whitening agent can be used in combination with a fade inhibitor.

In the present invention, in order to improve the releasing property of the thermal transfer dye donating material and image receiving material for thermal transfer printing, a releasing agent is preferably incorporated in at least one layer for composing the dye donating material and/or image receiving material, in particular, in the outermost layer corresponding to contacted surface of both the materials.

Examples of the releasing agent include solid- or wax-like materials such as polyethyelene waxes, amide waxes, teflon powders, etc.; surfactants such as of fluoro type, phosphoric acid ester type, etc.; oils such as of paraffin type, silicone type and fluoro type, which are known in the art. In particular, silicone oils are preferable.

As the silicone oil, there can be used, in addition to non-modified silicone oils, carboxy-modified, amino-modified, epoxy-modified silicone oils, etc. For example, various modified silicone oils are described in a technical document, "Modified Silicone Oils" page 6-18B, published by Shin-etsu Silicone KK. When using them in binders of organic solvent type, an amino-modified silicone oil having a group reactive with a cross-linking agent of the binder (e.g. group reactive with isocyanate) is effective and when using them by emulsifying and dispersing in water-soluble binders, a carboxy-modified silicone oil (e.g. X-22-3710, commercial name, manufactued by Shin-etsu Silicone KK) is effective.

The layers for composing the dye donating material and image receiving material used in the present invention may be hardened with a hardener.

In the case of hardening a polymer of organic solvent type, hardeners described in Japanese Patent Laid-Open Publication Nos. 199997/1986, 215398/1983, etc. can be used. For polyester resins, in particular, use of hardeners of isocyanate type is preferable.

Hardening of water-soluble polymers is preferably carried out by the use of hardeners disclosed in U.S. Pat. No. 4,678,739, col. 41 and Japanese Patent Laid-Open Publication Nos. 116655/1984, 245261/1987 and 18942/1986, illustrative of which are aldehyde hardeners such as formaldehyde, etc., aziridine hardeners, epoxy hardeners, vinylsulfone hardeners such as N,N'-ethylene-bis (vinylsulfonylacetamide)ethane, etc., N-methylolhardeners such as dimethylurea, etc. and high molecular hardeners (compounds described in Japanese Patent Laid-Open Publication No. 234157/1987, etc.).

A fading inhibitor can be used for the thermal tranfer dye donating material and image receiving material for thermal transfer printing. The fading inhibitor includes, for example, antioxidants, ultraviolets absorbers or some kinds of metal complexes.

As the antioxidant, for example, there are effectively used chroman compounds, cumarane compounds, phenol compounds such as hindered phenols, hydroquinone derivatives, hindered amine derivatives, spiroindan compounds, etc. Compounds described in Japanese Patent Laid-Open Publication No. 159644/1986 are also effective.

The ultraviolet absorber includes, for example, benzotriazole compounds (U.S. Pat. No. 3,533,794, etc.), 4-thiazolidone compounds (U.S. Pat. No. 3,352,681, etc.), benzophenone compounds (Japanese Patent Laid-Open Publication No. 2784/1981) and other compounds described in Japanese Patent Laid-Open Publication Nos. 48535/1979, 136641/1987, 88256/1986, etc. In addition, ultra-violet absorbing polymers described in Japanese Patent Laid-Open Publication No. 260152/1987 are also effective.

The metal complex includes compounds described in (U.S. Pat. Nos. 4,241,155 and 4,245,018, col. 3–36, U.S. Pat. No. 4,254,195, col. 3–8, Japanese Patent Laid-Open Publication Nos. 174741/1987 and 88256/1986, page 27–29, Japanese Patent Application Nos. 234103/1987, 311096/1987, 230596/1987, etc.

Useful examples of the fading inhibitor are described in Japanese Patent Laid-Open Publication No. 215272/1987.

The fading inhibitor to prevent a dye transferred to an image receiving material from fading may either be incorporated in the image receiving material or be supplied to the image receiving material from the outside, for example, by transferring from a dye donating material.

The above described antioxidants, ultraviolet absorbers and metal complexes can be used individually or in combination.

In the construction layers of the thermal transfer dye donating material or image receiving material for thermal printing, various surfactants can be used for the purpose of assisting the coating, improving the stripping property, improving the slipping property, improving the antistatic property, accelerating development, etc.

As the surfactant, there can be used, for example, nonionic surfactants, e.g. saponins (steroid type), alkylene oxide derivatives such as polyethylene glycols, polyethylene glycol alkyl ethers, polyethylene glycol alkyl aryl ethers, polyethylene glycol esters, polyethylene glycol sorbitan esters, polyalkylene glycols, alkylamine or amides, polyethylene oxide adducts of silicones, glycidol derivatives such as alkenylsuccinic acid polyglycerides, alkylphenol polyglycerides, fatty acid esters of polyhydric alcohols, alkylesters of sugars and the like; anionic surfactants having acid groups such as carboxy group, sulfo group, phospho group, sulfuric acid ester group, phosphoric acid esters group, etc., e.g. alkylcarboxylates, alkylsulfonates, alkylnaphthalenesulfonates, alkylsulfuric acid esters, alkylphosphoric acid esters, N-acyl-N-alkyltaurine, sulfosuccinic acid esters, sulfoalkylpolyethylene alkylphenyl ethers, polyoxyethylene alkylphopshoric acid esters and the like; amphoteric surfactants, e.g. amino acids, aminoalkylsulfonic acids, amioalkylsulfuric acid or phosphoric acid esters, alkylbetaines, amine oxides and the like; and cationic surfactants, e.g. alkylamine salts, aliphatic or aromatic quaternary ammonium salts, heterocyclic ring quaternary ammonium salts such as pyridinium, imidazolium, etc., and phosphonium or sulfonium salts containing aliphatic or heterocyclic rings. These examples are disclosed in Japanese Patent Laid-Open Publication Nos. 173463/1987, 183457/1987, etc.

When dispersing materials capable of receiving thermally migratable dyes, releasing agents, fading inhibitors, ultraviolet absorbers, fluorescent whitening agents and other hydrophobic compounds in water-soluble binders, surfactants are preferably used as a diseprsing aid. To this end, surfactants described in Japanes Patent Laid-Open Publication No. 157636/1984, page 37–38 are particularly preferable in addition to the above described surfactants.

In the construction layers of the thermal transfer dye donating material or image receiving material for thermal transfer printing, organo fluoro compounds can be incorporated for the purpose of improving the slipping property, improving the antistatic property, improving the releasing property, etc. Typical examples of the organo fluoro compound are hydrophobic fluoro compounds, for example, fluoro surfactants described in Japanese Patent Publication No. 9053/1982, col. 8–17, Japanes Patent Laid-Open Publication Nos. 20944/1986, 135826/1987, etc., oil-like fluoro compounds such as fluorine oils, solid fluoro compound resins such as tetrafluoroethylene resins and the like.

In the thermal transfer dye donating material or image receiving material for thermal transfer printing of the present invention, furthermore, a matting agent can be used, for example, silicon dioxide, compounds described in Japanese Patent Laid-Open Publication No. 88256/1986, page 29, such as polyolefins or methacrylates, and compounds described in Japanes Patent Laid-Open Publication Nos. 274944/1988 and 274952/1988, such as benzoguanamine resin beads, polycarbonate resin beads, AS resin beads, etc.

The following examples are given in order to illustrate the present invention in detail without limiting the same.

EXAMPLE 1

Preparation of Thermal Transfer Dye Donating Material (D-1)

Using a polyethylene terephthalate film having a thickness of 5 μm, provided on one side with a heat resistant slidable layer, as a substrate, Composition (1) for coating a dye donating layer, having the following composition, was coated onto the opposite side to the heat resistant slidable layer, was coated to give a thickness of 0.6 μm on dry basis by means of a gravure coater, thus obtaining Thermal Transfer Dye Donating Material (D-1) (which will also hereinafter be referred to as "Dye Donating Material" simply).

| Composition (1) for Coating Dye Donating Layer | |
|---|---|
| Dye 1 | 10 g |
| Polyvinylbutyral (Denka Butyral 5000 A, commercial name, manufactured by Denki Kagaku KK) | 10 g |
| Silicone Oil (KF-96, commercial name, manufactured by Sin-etsu Kagaku KK) | 0.2 g |
| Polyisocyanate (Takenate C 110 N, commercial name, manufactured by Takeda Yakuhin KK) | 0.5 g |
| Methyl Ethyl Ketone | 100 ml |
| Toluene | 80 ml |

Preparation of Image Receiving Material for Thermal Transfer Printing (P-1)

Using a synthetic paper of laminated type, having a thickness of 150 μm as a substrate, Composition (1) for coating an image receiving layer, having the following composition, was coated onto the surface thereof to give a thickness of 5 μm on dry basis by means of a wire bar coater, thus obtaining Image Receiving Material for Thermal Transfer Printing (P-1) (which will also hereinafter be referred to as "Image Receiving Material" simply). Drying was carried out in an oven at 80° C. for 1 hour after expedient drying by a drier.

| Composition (1) for Coating Image Receiving Layer | |
|---|---|
| Dye Fixing Agent: A-9 (AEA, commercial name, manufactured by Sankyo KK) | 26 g |
| Polyisocyanate (KP-90, commercial name, manufactured by Dainippon Ink Kagaku KK) | 4 g |
| Amino-modified Silicone Oil (KP-857, commercial name, manufactured by Sin-etsu Silicone KK) | 0.5 g |
| Methyl Ethyl Ketone | 100 ml |
| Toluene | 50 ml |
| Cyclohexane | 10 ml |

Preparation of Dye Donating Materials (D-2) to (D-10) and (A) to (C)

Dye Donor Materials (D-2) to (D-10) and Comparative Dye Donating Materials (A) to (C) were prepared in an analogous manner to Dye Donating Material (D-1) except changing Dye 1 and the binder resin in those shown in Table 4:

TABLE 4

| Dye Donor Material | Dye No. | Binder Resin |
|---|---|---|
| D-1 | 1 | Denka Butyral 5000 A |
| D-2 | 3 | " |
| D-3 | 5 | Ethyl Cellulose |
| D-4 | 6 | " |
| D-5 | 8 | Denka Butyral 5000 A |
| D-6 | 16 | " |
| D-7 | 27 | " |
| D-8 | 32 | " |
| D-9 | 40 | " |
| D-10 | 2/15(=1/1) | Ethyl Cellulose |
| (A) | (a) | Denka Butyral 5000 A |
| (B) | (b) | " |
| (C) | (c) | " |

(a)

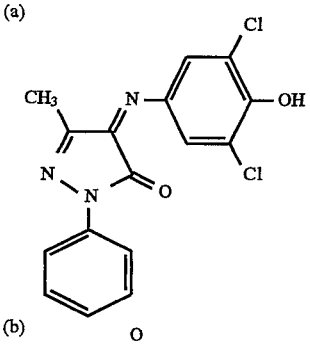

(b)

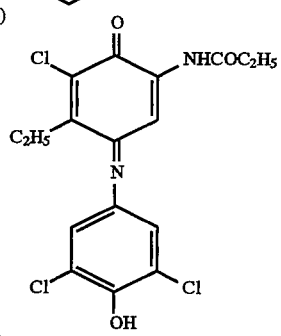

(c)

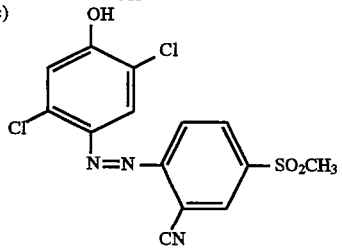

Transferring Experiment

When the thus obtained thermal transfer dye donating material and image receiving material for thermal transfer printing were superposed in such a manner that the dye donating layer and image receiving layer were brought into contact with each other, subjected to heating from the substrate side of the thermal transfer dye donating material using a thermal head under conditions of a thermal head output of 0.25 W/dot, a pulse width of 0.1 to 10 msec and a dot ensity of 6 dots/mm and the dye was imagewise adhered to the image receiving layer of the image receiving material, recording of a transfer-unevenness free, clear image was obtained. The maximum transfer density of the image was measured by measuring an area (Dmax area) where the density of the image receiving material having been subjected to recording was saturated by the use of a densitometer of reflection type (X manufactured by Rite Inc., having Status A Filter).

The recorded image receiving material was irradiated by a fluorescent light of 17,000 luxes for 3 days to investigate the light fastness of the image. The stability was assessed by measuring the reflection density after testing of the area of exhibiting a reflection density of 1.0 and seeking a residual ratio (%) to the reflection density of 1.0 before testing.

When the recorded image receiving material was stored in an oven at 60° C. for one week to investigate the heat stability of the image, there was hardly found lowering of the density or discoloration in the combination of the materials of the present invention, from which the stability was confirmed.

Furthermore, the degree of bleeding of the image was observed after storage of the recorded image receiving material in an oven at 60° C. for two weeks. The judgment standards were represented by ○ when the image was hardly changed in comparison with before the storage, Δ when some bleeding was found and X when much bleeding or fading was observed.

The results are shown in Table 5, from which it is apparent that in the case of using the dye of the present invention, there is obtained a clear image with a higher transfer density and an excellent light or heat fastness and no image fading occurred during the passage of time. Moreover, color migration (contamination due to migration of a dye from the transferred image surface by contacting of a surface having a transferred image with a surface or back surface of an image receiving paper, having no transferred image) did not take place. On the other hand, in the case of using the comparative dye donating material, Samples A and B respectively result in a lower transferring property, a lower transfer density due to insufficient dissociation of the dye after transferred and an unclear image with respect to the hue. In the case of using a non-dissociative dye as in Sample C, image fading was observed in the bleeding test.

TABLE 5

| Dye Donating Material | Maximum Transfer Density (Dmax) | Light Fastness (Dye Residual Ratio %) | Image Fading | Remarks |
|---|---|---|---|---|
| D-1 | 2.25 | 72 | ○ | Invention |
| D-2 | 2.18 | 78 | ○ | Invention |
| D-3 | 2.20 | 70 | ○ | Invention |
| D-4 | 2.32 | 76 | ○ | Invention |
| D-5 | 2.35 | 81 | ○ | Invention |
| D-6 | 2.15 | 65 | ○ | Invention |
| D-7 | 2.08 | 71 | ○ | Invention |
| D-8 | 2.03 | 74 | ○ | Invention |
| D-9 | 2.01 | 68 | ○ | Invention |
| D-10 | 2.54 | 75 | ○ | Invention |
| A | 1.18 | 42 | Δ | Comparison |
| B | 1.06 | 69 | Δ | Comparison |
| C | 1.57 | 48 | ○ | Comparison |

EXAMPLE 2

Preparation of Image Receiving Materials for Thermal Transfer

Printing (P-2) to (P-5)

Image Receiving Materials (P-2) to (P-5) were prepared in an analogous manner to Example 1 except using dye fixing agents and binder resins shown in in Table 6 instead of the dye fixing agent A-9 in Composition (1) for coating an image receiving layer of Image Receiving Material for Thermal Transfer Printing (P-1) in Example 1.

TABLE 6

| Image Receiving Material | Dye Fixing Agent | | Binder Resin | |
|---|---|---|---|---|
| P-2 | A-10 | 20 g | Denka Butyral 3000 A | 6 g |
| P-3 | A-11 | 26 g | — | |
| P-4 | A-12 | 26 g | — | |
| P-5 | A-13 | 13 g | A-9 (AEA) | 13 g |

Transferring Experiment

Using the thermal transfer dye donating material obtained in Example 1 and the above described Image Receiving Materials for Thermal Transfer Printing (P-2) to (P-5), a traferring experiment was carried out in the similar manner to Example 1. Consequently, there was obtained a transfer unevenness-free, clear, high density, full color image recording. This image was excellent in light and heat fastness and exhibited no image fading.

EXAMPLE 3

| Composition (6) for Coating Image Receiving Layer | |
|---|---|
| Dye Fixing Agent: A-4 | 15 g |
| Binder: Gelatin | 10 g |
| Hardener: 1,4-Butanediol Diglycidyl Ether | 4 g |
| Silicone Oil: SF-8421 (commercial name, manufactured by Toray Silicone KK) | 0.2 g |
| Water | 145 ml |

Image Receiving Material for Thermal Transfer Printing (P-6) was prepared in an analogous manner to Example 1 except using the above described Composition (6) in place of Composition (1) for Coating Image Receiving Layer of Example 1. When image recording was similarly carried out using this image receiving material for thermal transfer printing and the thermal transfer dye donating materials shown in Table 5, there was obtained a transfer unevenness-free, clear transferred image. The maximum transfer density of this image as well as the heat or light fastness were excellent in the similar manner to the combination of Example 1 and moreover, no image fading was found.

Advantages of the Present Invention

When using the thermal transfer recording material according to the present invention, there can be obtained a full color image having a high transfer density as well as excellent color reproducibility and having an excellent storage property and free from lowering of the sharpness even during the passge of time.

What is claimed is:

1. A thermal transfer recording material comprising a thermal transfer dye donating material containing a thermally migratable dye capable of donating hydrogen atom to be anion and an image receiving material for thermal transfer printing, containing at least one of basic materials and mordants as a dye receiving compound, in which at least one of the thermally migratable dyes is a heteryl azo dye of phenol type represented by General Formula (1) or its derivative:

General Formula (1)

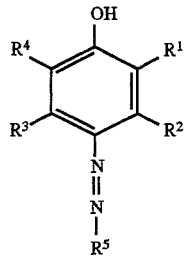

(1)

wherein $R^1$, $R^2$, $R^3$ and $R^4$ independently and respectively represent a hydrogen atom or atomic group of nonmetals, $R^3$ and $R^4$ may be bonded to form a five to six membered group and $R^5$ represents a heterocyclic group.

2. The thermal transfer recording material as claimed in claim 1, wherein $R^5$ is a five to six membered heterocyclic group having at least one of nitrogen, oxygen and sulfur atoms, which may be condensed.

3. The thermal transfer recording material as claimed in claim 1, wherein the dye having the six membered heterocyclic group through bonding of $R^3$ and $R^4$ is represented by General Formula (2) or (3):

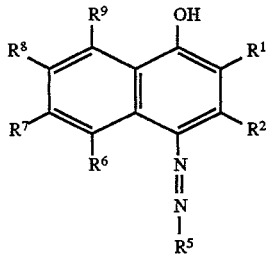

(2)

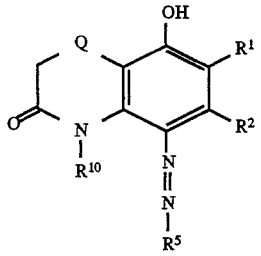

(3)

wherein $R^1$, $R^2$ and $R^5$ have the same meanings as defined in General Formula (1), $R^6$, $R^7$, $R^8$ and $R^9$ have the same meanings as defined in $R^1$ of General Formula (1), $R^{10}$ is a hydrogen atom or an alkyl group (1 to 12 carbon atoms) and Q is an atomic group necessary for forming a 5 to 7 membered ring.

4. The thermal transfer recording material as claimed in claim 1, wherein the thermal transfer dye donating material comprises a dye donating layer provided on a substrate and the image receiving material for thermal transfer printing comprises an image receiving layer provided on another substrate.

5. The thermal transfer recording material as claimed in claim 4, wherein the dye donating layer has a thickness of about 0.2 to 5 μm.

6. The thermal transfer recording material as claimed in claim 4, wherein the dye donating layer is formed by dissolving or dispersing a thermally migratable dye in a solvent with a binder resin and coating onto the substrate.

7. The thermal transfer recording material as claimed in claim 6, wherein the binder is present in a proportion of about 20 to 600 weight parts to 100 weight parts of the dye.

8. The thermal transfer recording material as claimed in claim 4, wherein the substrate has a thickness of 2 to 30 μm.

9. The thermal transfer recording material as claimed in claim 1, wherein the thermal transfer dye donating material is in the form of a sheet, continuous roll or ribbon.

10. The thermal transfer recording material as claimed in claim 4, wherein the thermal transfer dye donating material further comprises a slipping layer, hydrophilic barrier layer or undercoated layer.

11. The thermal transfer recording material as claimed in claim 4, wherein the image receiving layer contains at least one of basic materials and mordants, which are capable of receiving a dye migrated from the dye donating material on the substrate and dissociating the received dye, individually or in combination with a binder material.

12. The thermal transfer recording material as claimed in claim 11, wherein the basic materials and mordants are polymeric dye fixing agents having a molecular weight of $1\times10^3$~$1\times10^6$.

13. The thermal transfer recording material as claimed in claim 12, wherein the dye fixing agent is used in a coating amount of 0.2 to 30 g/m$^2$.

14. The thermal transfer recording material as claimed in claim 4, wherein the image receiving layer has a thickness of about 0.5 to 50 μm.

15. The thermal transfer recording material as claimed in claim 4, wherein the image receiving material for thermal transfer printing has an intermediate layer between the image receiving layer and other substrate.

16. The thermal transfer recording material as claimed in claim 15, wherein the intermediate layer has two or more functions as a cushioning layer, porous layer and dye diffusion inhibiting layer.

* * * * *